United States Patent [19]

Cha

[11] 4,105,072

[45] Aug. 8, 1978

[54] PROCESS FOR RECOVERING CARBONACEOUS VALUES FROM POST IN SITU OIL SHALE RETORTING

[75] Inventor: Chang Yul Cha, Bakersfield, Calif.

[73] Assignee: Occidental Oil Shale, Grand Junction, Colo.

[21] Appl. No.: 763,155

[22] Filed: Jan. 27, 1977

Related U.S. Application Data

[63] Continuation-in-part of Ser. No. 748,622, Nov. 29, 1976, abandoned, which is a continuation of Ser. No. 652,335, Jan. 26, 1976, abandoned, which is a continuation of Ser. No. 504,028, Sep. 9, 1974, abandoned, and a continuation-in-part of Ser. No. 622,653, Oct. 16, 1975, Pat. No. 4,005,752, which is a continuation of Ser. No. 492,253, Jul. 26, 1974, abandoned.

[51] Int. Cl.[2] ..... E21B 43/24; E21B 43/26

[52] U.S. Cl. ..... 166/261; 166/259; 299/2; 299/4

[58] Field of Search ..... 166/251, 256, 257, 260, 166/261, 258, 259, 302; 299/2–6

[56] References Cited

U.S. PATENT DOCUMENTS

| | | | |
|---|---|---|---|
| 1,919,636 | 7/1933 | Karrick | 299/2 |
| 3,001,775 | 9/1961 | Allred | 166/257 |
| 3,346,044 | 10/1967 | Slusser | 166/259 X |
| 3,362,471 | 1/1968 | Slusser et al. | 166/251 |
| 3,400,762 | 9/1968 | Peacock et al. | 166/259 |
| 3,460,620 | 8/1969 | Parker | 166/247 UX |
| 3,499,489 | 3/1970 | Parker | 166/258 |
| 3,548,938 | 12/1970 | Parker | 166/256 |
| 3,586,377 | 6/1971 | Ellington | 299/4 |
| 3,596,993 | 8/1971 | Busey | 166/257 |
| 3,882,941 | 5/1975 | Pelofsky | 166/263 X |

*Primary Examiner*—Stephen J. Novosad
*Attorney, Agent, or Firm*—Christie, Parker & Hale

[57] ABSTRACT

In a process for recovering liquid and gaseous products from an in situ oil shale retort containing a fragmented permeable mass of particles containing oil shale, a heated zone is established in an upper portion of the fragmented mass. For a period of normal retorting operation, an oxygen containing gas is introduced to the fragmented mass on the trailing side of the heated zone at a sufficient rate for advancing the heated zone downwardly through the fragmented mass and liquid products and a relatively lean off gas containing gaseous products are withdrawn from the bottom of the retort. Thereafter, for a period of post-retorting operation, the introduction of gas to the fragmented mass is reduced to a rate such that a relatively rich off gas is withdrawn from the retort. The rich withdrawn off gas preferably has a heating value of at least about 75 BTU/SCF. The reduced rate of introduction includes substantial closing of an end of the retort or introduction of gas at a rate less than about 10% of the rate of introduction of gas to the retort during normal retorting operation. Relatively rich off gas from post-retorting operation is preferably withdrawn from the top of the retort and can be used for igniting another retort or for sustaining a secondary combustion zone in a second retort.

45 Claims, 3 Drawing Figures

PROCESS FOR RECOVERING CARBONACEOUS VALUES FROM POST IN SITU OIL SHALE RETORTING

BACKGROUND

This application is a continuation-in-part of co-pending patent application Ser. No. 748,622 filed Nov. 29, 1976, which is a continuation of patent application Ser. No. 652,335 filed on Jan. 26, 1976, which is a continuation of patent application Ser. No. 504,028 filed Sept. 9, 1974, each of which is now abandoned, and is also a continuation-in-part of application Ser. No. 622,653, filed Oct. 16. 1975, now U.S. Pat. No. 4,005,752, which is a continuation of application Ser. No. 492,253, filed July 26, 1974, now abandoned; the subject matter of which is hereby incorporated by reference.

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit interspersed with layers containing an organic polymer called "kerogen", which upon heating thermally decomposes to produce carbonaceous liquid and gaseous products. It is the formation containing kerogen that is called "oil shale" herein, and the liquid carbonaceous product is called "shale oil".

A number of methods have been developed for processing the oil shale which involve either first mining the kerogen bearing shale and processing the shale above ground, or processing the shale in situ. The latter approach is preferable from the standpoint of environmental impact since the spent shale remains in place, reducing the change of surface contamination and the requirement for disposal of solid wastes.

The recovery of liquid and gaseous products from formations containing oil shale has been described in several patents, one of which is U.S. Pat. No. 3,661,423, issued May 9, 1972, to Donald E. Garrett, assigned to the assignee of this application, and incorporated herein by reference. This patent describes in situ recovery of liquid and gaseous carbonaceous materials from a subterranean formation containing oil shale. According to the process described in this patent, a portion of a subterranean deposit or formation containing oil shale is removed by conventional mining techniques to leave a void. A remaining portion of the formation is then fragmented and explosively expanded to form a stationary, permeable, fragmented mass of formation particles containing oil shale, referred to herein as an in situ oil shale retort. The portion mined from the in situ retort being formed is in the range of from about 5 to 25% of the volume of the in situ oil shale retort being formed. Hot retorting gases are passed through the fragmented permeable mass in the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a heated zone such as a combustion zone in the retort and introduction of an oxygen containing inlet gas such as air into the combustion zone to advance the combustion zone through the fragmented mass in the retort. The combustion zone can be established in the fragmented mass by burning a hydrocarbon containing gas in the presence of air. In the combustion zone, oxygen in the inlet processing gas is depleted by reaction with hot residual carbonaceous materials to produce spent or dekerogenated oil shale and heat. By the continued introduction of the oxygen containing inlet gas into the combustion zone, the combustion zone is advanced through the retort.

Hot effluent gas from the combustion zone passes through the retort on the advancing side of the combustion zone to heat oil shale in a retorting zone in the fragmented mass to a temperature sufficient to produce thermal decomposition of kerogen, called retorting, in the oil shale to gaseous and liquid products and a residual product of solid carbonaceous material. Heat of combustion is carried from the combustion zone to the retorting zone largely by gas flow. Thermal decomposition of kerogen in the oil shale proceeds at about 800° F, and appreciable quantities of carbonaceous materials are driven off from the oil shale at even lower temperatures.

The combustion and retorting zones are advanced through the fragmented permeable mass in the retort until near or at the end of the fragmented mass. Cooling by cold gas or air introduced into the retort on the trailing side of the combustion zone forms a cooling zone on the trailing side of the combustion zone. Cooling below the ignition temperature and depletion of carbonaceous material in spent shale on the trailing side of the combustion zone can cause discontinuance of combustion on the trailing side of the combustion zone. As used herein, the term "heated zone" refers to a hot portion of the fragmented mass such as a combustion zone and/or a retorting zone. Further, as retorting proceeds, a substantial portion of shale on the trailing side of the combustion zone can be hot enough to effect retorting of oil shale. This portion which has not been cooled by inlet gas can be part of the heated zone. The heated zone is regarded as that region at a temperature above the retorting temperature of oil shale.

The liquid products and gaseous products of kerogen decomposition are cooled by the cooler oil shale particles in the retort on the advancing side of the retorting zone. A liquid product stream is collected at the bottom of the retort and withdrawn to the surface of the ground through an access tunnel, drift, or shaft. The liquid product stream includes shale oil and water. An off gas containing combustion gas generated in the combustion zone, gaseous products produced in the retorting zone, including hydrocarbons and hydrogen, gas from carbonate decomposition, and the portion of inlet gas that does not take part in the combustion process is also collected at the bottom of the retort and withdrawn to the surface. Such off gas is generally lean, having a relatively low heating value of from about 20 to 100 BTU/SCF and often in the order of about 50 BTU/SCF. The heating value of such off gas from normal retorting operation can be too low for the off gas to be used alone as a fuel gas for establishment of a combustion zone in an in situ oil shale retort.

In the above-described process, a portion of the fragmented mass can be left unretorted. This can result from gas flow maldistribution through the retort such as channeling of gas flow through the fragmented permeable mass of formation particles in the retort and non-uniform and uneven gas flow through the retort due to non-uniform or uneven void fraction and particle size distribution in the retort. Uneven distribution of void fraction and particle size can occur in an in situ retort because of variations in the blasting technique employed and the amount of explosive used in preparing the in situ retort, as well as physical properties of the formation containing oil shale. Because of such gas flow maldistribution, the front of the retorting zone can be non-uniform. Thus, when normal retorting is completed, some of the fragmented mass in a portion of the retort can remain unretorted. In particular, when advancing a retorting zone downwardly through a retort, a portion of the fragmented mass near the bottom of the retort can be left unretorted.

Another source of unretorted oil shale in the tract being developed by in situ retorting is formation left unfragmented to function as pillars between in situ retorts. Such pillars can support overburden and serve as barriers to substantial gas flow between fragmented masses in adjacent retorts. The portion of the formation left as pillars can be a significant proportion of the entire formation and can be, for example, approximately 30% of the entire formation in a tract being treated by means of an in situ retorting process. Since the formation present in such pillars has low permeability and low thermal diffusivity, the rate of retorting oil shale in the pillars is slower than in the fragmented permeable mass of formation particles in the retort. Hence, oil shale in the pillars, and particularly oil shale in pillars near the bottom of a retort when a retorting zone is advanced downwardly through the retort, can be left unretorted at the end of normal retorting operation.

Thus, following completion of normal in situ retorting operation, it is desirable to increase the yield or recovery of hydrocarbons from an in situ oil shale retort by recovering carbonaceous values from unretorted oil shale remaining in pillars adjacent the fragmented mass in the retort and from portions of the mass of formation particles containing unretorted oil shale in the retort. A post-retorting operation is, therefore, provided in practice of this invention.

As used herein, normal retorting operation refers to retorting of oil shale in a fragmented permeable mass in an in situ oil shale retort by advancing a heated retorting zone therethrough, with transfer of heat through the fragmented permeable mass being primarily by means of gas flow. Exemplary of the rate of normal retorting operation is an advance of a retorting zone between about one and two feet per day. In one example a retorting zone advances through about 270 feet of fragmented permeable mass in about 165 days of retorting.

As used herein, post-retorting operation refers to a period after the end of normal retorting operation; that is, it refers to a period after a retorting zone has advanced through substantially all of the fragmented permeable mass in the retort. As noted hereafter, during post-retorting operation heat transfer by conduction and radiation are important.

SUMMARY OF THE INVENTION

Accordingly, there is provided a process for recovering liquid and gaseous products from oil shale in an in situ oil shale retort in a subterranean formation containing oil shale, the retort containing a fragmented permeable mass of formation particles containing oil shale, after the normal retorting operation is complete. According to this process, a heated zone is established in the fragmented mass. For a first period of normal retorting operation a processing gas is introduced to the fragmented mass on the trailing side of the heated zone at a sufficient rate for advancing the heated zone through the fragmented mass. During this period of normal retorting operation liquid products and off gas containing gaseous products are withdrawn from the retort on an advancing side of the heated zone. For a second period of post-retorting operation, introduction of gas into the fragmented mass is reduced and off gas including gaseous products from retorting oil shale is withdrawn from the retort. The rate of gas introduction is sufficiently reduced that the withdrawn off gas has a heating value of at least about 50 BTU/SCF. Preferably the heating value is at least about 75 BTU/SCF.

During post-retorting operation, the introduction of gas to the retort can be substantially completely stopped. This can be effected by closing an inlet to the retort. Also during the post-retorting operation, relatively rich off gas is preferably withdrawn from the retort at a sufficient rate to prevent pressure buildup inside the retort, and can be withdrawn from the retort at a rate sufficient to reduce the pressure in the retort to less than ambient pressure in adjacent underground workings.

Relatively high heating value off gas produced during post-retorting operation of a first retort can be used for establishing a heated zone in a second in situ oil shale retort. This is effected by burning the relatively rich off gas with an oxygen containing gas at the inlet to the new retort.

DRAWINGS

These and other features and advantages of processes provided in practice of this invention will be more clearly understood by reference to the following detailed description of the invention, when considered in connection with the accompanying drawings wherein.

DETAILED DESCRIPTION

Figure 1:
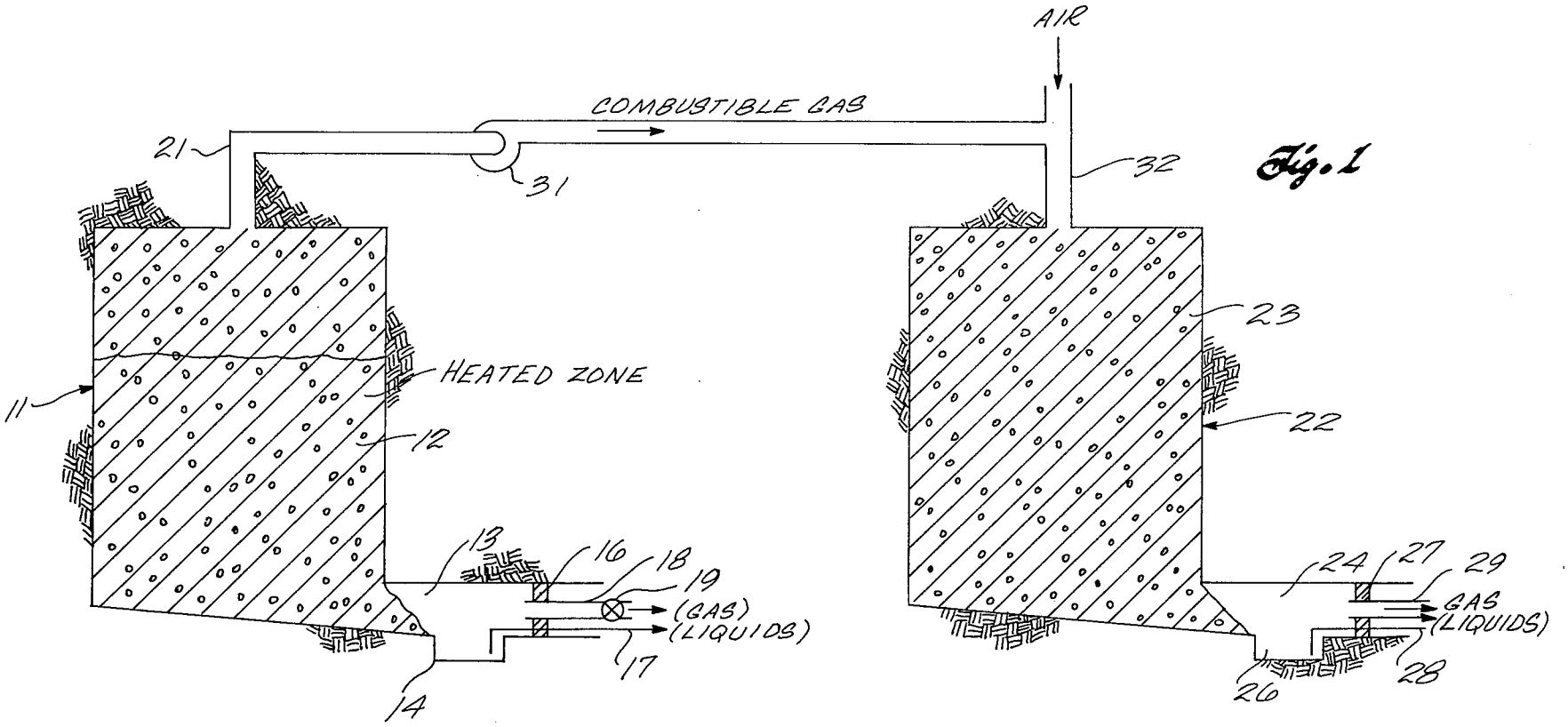
FIG. 1 is a schematic representation of two in situ oil shale retorts.

FIG. 1 illustrates semi-schematically a pair of in situ oil shale retorts for practice of processes in accordance with this invention. As illustrated in this embodiment there is a first in situ oil shale retort 11 which is in a subterranean formation containing oil shale. The in situ oil shale retort comprises a subterranean cavity in the formation containing a fragmented permeable mass 12 of particles of the formation containing oil shale. The cavity containing the fragmented permeable mass and the fragmented mass can be formed by a variety of techniques, details of which are not important for understanding this invention. One technique for forming a fragmented permeable mass in an in situ oil shale retort is described in aforementioned U.S. Pat. No. 3,661,423.

The fragmented permeable mass of particles has boundaries of unfragmented formation. The unfragmented formation is essentially intact without appreciable void volume and, if desired can be fractured for enhanced permeability. Walls of unfragmented formation adjacent side boundaries of the fragmented permeable mass are sometimes referred to as pillars. Such pillars can contain substantial amounts of oil shale.

In the embodiment illustrated schematically in FIG. 1 there is access to the bottom of the fragmented permeable mass by way of an access drift 13. A sump 14 is provided in the access drift for recovering liquid products of retorting. The sump is between the fragmented permeable mass and a substantially gas tight bulkhead 16 in the access drift. A conduit 17 is provided through the bulkhead for withdrawing liquid products from the sump. A gas conduit 18 also extends through the bulkhead for withdrawing off gas from a lower portion of the fragmented mass in the retort. Means are also provided for closing the gas conduit 18, such as by way of a valve 19 illustrated schematically in FIG. 1. Access means, such as a gas conduit 21, are also provided for introducing or withdrawing gas from the top of the fragmented permeable mass in the retort. A plurality of such access openings to the top of the fragmented mass can also be used.

During normal retorting operation, a processing gas is introduced through the access means 21 at the upper portion of the fragmented permeable mass in the retort. A heated zone is established in the fragmented mass in the retort and advanced therethrough from the top toward the bottom. The heated zone is advanced through the fragmented mass by gas flow as processing gas is introduced at the top of the retort and an off gas is withdrawn at the bottom of the retort by way of the gas conduit 18.

The heated zone has a temperature at least as high as the retorting temperature for oil shale so that kerogen in oil shale in the retort is decomposed to produce liquid and gaseous products. Liquid products percolate to the sump 14 from which they are withdrawn and gaseous products are withdrawn with the off gas by way of the gas conduit 18.

In a preferred embodiment a heated zone is established in an upper portion of the fragmented mass in the in situ retort. The heated zone can be established by any of a variety of techniques, including an off gas burning technique as hereinafter described. The heated zone has a temperature above the ignition temperature of carbonaceous material in the oil shale. When a sufficient heated zone is established, oxygen containing gas is introduced to the upper portion of the fragmented mass for processing oil shale therein. The oxygen containing gas can be air augmented with oxygen or air diluted with recycled off gas or steam. Other oxygen containing gas can also be used for establishing and sustaining a combustion zone in the fragmented mass. For convenience the oxygen containing gas may be referred to herein as "air".

Oxygen so introduced into the fragmented permeable mass reacts with carbonaceous material in oil shale for generating heat in a combustion zone. Gas flowing downwardly from the combustion zone, including combustion products, gas from carbonate decomposition and that portion of the inlet processing gas that does not react in the combustion zone, flows downwardly through the fragmented mass and carries heat of combustion to a retorting zone on the advancing side of the combustion zone. Kerogen is decomposed in the retorting zone to produce liquid and gaseous products.

As the heated zone comprising the combustion zone and retorting zone advances through the fragmented mass, its thickness or vertical height increases since the rate of heat generation is greater than the rate of cooling of spent shale on the trailing side of the combustion zone by relatively cool inlet processing gas. At the end of normal retorting operation when the retorting zone reaches near the bottom of the fragmented mass in the retort, the heated zone can include a substantial portion of the vertical height of the fragmented mass in the retort.

When kerogen decomposes in the retorting zone to produce liquid and gaseous products a solid carbonaceous residue remains in the shale. Such carbonaceous residue supports combustion in the combustion zone. An appreciable amount of such residual carbonaceous product can remain in the heated zone at the end of normal retorting operation.

Thus, an appreciable resource is left at the end of normal retorting operations. This resource includes a high temperature source of heat in the heated zone, appreciable quantities of oil shale in pillars of unfragmented formation outside the boundaries of the fragmented permeable mass, and unburned residual carbonaceous product in retorted oil shale. Under some circumstances unretorted oil shale can remain in the fragmented permeable mass at the end of normal retorting operation. Post-retorting operations are therefore conducted for utilizing at least part of such resources.

FIG. 1 illustrates schematically an arrangement for such post-retorting operation. As illustrated in this embodiment there is a second in situ oil shale retort 22 in the form of a cavity in unfragmented formation and containing a fragmented permeable mass 23 of particles containing oil shale. Such a retort is similar to the first retort 11 hereinabove described. An access drift 24 communicates with the lower portion of the fragmented mass in the in situ oil shale retort. A sump 26 is provided in the access drift. A substantially gas tight bulkhead 27 is provided in the access drift. A liquid withdrawal conduit 28 extends through the bulkhead from the sump 26. An off gas conduit 29 also extends through the bulkhead in the access drift.

In the arrangement illustrated in FIG. 1 the first mentioned in situ oil shale retort 11 is at the end of normal retorting operation and the fragmented permeable mass 12 has been substantially completely retorted; that is, kerogen in oil shale in the fragmented permeable mass has been heated and decomposed for producing gaseous and liquid products, thereby leaving solid residual carbonaceous product. A lower part of substantial height of fragmented mass in the retort has a heated zone H at a temperature above the retorting temperature of oil shale. At least a portion of the heated zone contains solid residual carbonaceous product of kerogen decomposition. The second mentioned in situ oil shale retort 22 contains a fragmented permeable mass 23 containing raw or unprocessed oil shale; that is, oil shale which has not yet been subjected to heating and decomposition of kerogen.

During post-retorting as illustrated in FIG. 1 a gas blower 31 or the like has an inlet connected to the gas access 21 at the top of the first mentioned retort containing a heated zone near the bottom. The outlet of the gss blower 31 is connected to a gas access conduit 32 to the top of the fragmented mass 23 in the second mentioned in situ oil shale retort containing a fragmented mass of unprocessed oil shale. Air or other oxygen containing gas is also introduced to the fragmented permeable mass of unprocessed oil shale in the second retort. Off gas withdrawn from the top of the retort containing a large heated zone is burned at the top of the retort containing a fragmented mass containing raw or unprocessed oil shale. Such burning of combustible off gas establishes a heated zone in the upper portion of the fragmented mass in the second retort. Sufficient heat can be introduced in this manner to raise the temperature of oil shale in the top of the fragmented mass to the ignition temperature of carbonaceous material in the oil shale, thereby providing ignition for a combustion zone to be established in the second retort. The second retort is so readied for normal retorting operations.

During such post-retorting operation the valve 19 is closed so that the lower portion of the in situ retort 11 containing the heated zone is substantially closed to introduction of gas. Heat from the heated zone in the fragmented permeable mass is transferred primarily by radiation and conduction in the fragmented mass and primarily by conduction in unfragmented pillars adjacent the fragmented mass. Such heat transfer from the heated zone H raises the temperature of unfragmented formation adjacent the fragmented mass, and of unretorted particles containing oil shale within the fragmented mass, if any, to temperatures at which retorting of kerogen proceeds.

Thus, during post-retorting operation of the first retort 11, additional decomposition of kerogen occurs, yielding gaseous and liquid products. Such gaseous products are withdrawn in off gas from the top of the fragmented mass. Liquid products produced during post retorting operation can percolate to the bottom and be withdrawn from the sump 14. At least a portion of such liquid products are exposed to sufficiently high temperatures that vaporization and/or thermal cracking occur. This results in additional gaseous products withdrawn in off gas from the top of the fragmented mass. Under some conditions little liquid product accumulates in the sump at the bottom due to secondary thermal cracking.

Heat transfer by reason of gas flow in the fragmented mass is relatively small since the flow rate of gas is small by comparison with the flow rate of gas during normal retorting. The post-retorting gas flow rate can be a few percent of the gas flow rate during normal retorting operation. Initially it can be 1515; % of the normal retorting rate and gradually decrease.

It is preferred to maintain a pressure slightly below ambient pressure in adjacent underground workings for avoiding leakage of off gas from the retort into adjacent tunnels or drifts which may be occupied by personnel. A few inches of water negative pressure (pressure below ambient in adjacent workings) is sufficient to prevent such leakage. The rate of withdrawal of off gas from the retort during post retorting operation is at least sufficient to prevent pressure build-up inside the retort.

When gas from thermal decomposition is withdrawn from the retort and a slightly negative pressure maintained in the retort, there can be some leakage of air into the retort. Such flow is preferably minimized to avoid unwanted oxidation of fuel components of the off gas and dilution of the off gas, which would reduce its heating value.

Since there is minor gas flow due to continual withdrawal of relatively high heating value off gas from the retort, there is some minor heat transfer by way of the sensible heat of the off gas. Since during this second period of time, the gas flow is quite small by comparison with gas flow rate during normal retorting, convective heat transfer is small and sensible heat in the heated zone is transferred primarily by radiation and conduction.

Off gas withdrawn from the top of the in situ oil shale retort during post-retorting operation is at a temperature substantially below the temperature of the heated zone H since such gas passes through a zone of cooled shale between the heated zone and the gas access conduit 21 at the top of the fragmented mass. In one embodiment off gas withdrawn from the top of an in situ oil shale retort containing a fragmented mass having a heated zone near the bottom was in the range of about 175° to 180° F.

Since there is no significant inlet gas flow to the retort, little heat is lost by way of convective heat transfer. Transfer of heat by radiation and conduction is relatively slow, hence, the rate of cooling in the fragmented permeable mass in the retort is slow and the boundaries of the fragmented mass at the lower portion of the retort can be at a high temperature, e.g. greater than 1000° F, for a significantly extended period. This maintains continuous heat conduction from the heated zone in the fragmented mass into adjacent unfragmented formation to cause thermal decomposition of kerogen in oil shale in the pillars of unfragmented formation. The resulting liquid and gaseous products diffuse through the formation toward and into the retort, thereby recovering carbonaceous values from the unfragmented formation.

As an example of practice of a process according to this invention, an in situ oil shale retort about 120 feet square in horizontal cross section and about 270 feet high was prepared in the Piceance Creek Basin region of Colorado. The in situ retort contained a fragmented permeable mass of formation particles containing oil shale. The average Fischer Assay of oil shale in the fragmented mass was less than about 15 gallons/ton. The richest oil shale, that is the portion of the formation having the highest Fischer Assay, was in approximately the middle third of the height of the retort. The lowest third of the formation had a Fischer Assay less than about ten gallons/ton.

An upper portion of the fragmented mass in the in situ oil shale retort was ignited by introducing air and fuel and burning the resultant mixture. This raised a substantial portion of the particles in the upper portion of the fragmented mass to an ingition temperature. Oxygen containing gas was introduced to an upper portion of the fragmented mass in the retort for establishing a combustion zone, and advancing the combustion zone downwardly through the fragmented mass. Off gas was withdrawn from a lower portion of the fragmented mass and the resultant flow of gas downwardly through the retort carried heat of combustion downwardly from the combustion zone into a retorting zone.

Thermal decomposition of kerogen in oil shale in the retorting zone yielded gaseous and liquid hydrocarbon products including shale oil. Shale oil and water percolated downwardly through the fragmented mass and were withdrawn from the bottom of the retort. The off gas withdrawn from the bottom of the retort included gaseous products.

Such normal retorting operation was conducted for about five and one-half months, during which time the heated zone advanced from the top to the bottom of the fragmented mass in the retort. During such normal retorting operation various mixtures of inlet processing gas containing oxygen were introduced at different times, including 100% air; 70% (by volume) air and 30% recycled off gas; and 70% air and 30% water vapor. The heating value of off gas withdrawn during normal retorting operation varied with oil shale grade and composition and flow rate of inlet gas. Average gas flow rate during normal retorting operation was about 0.62 SCFM per square foot of horizontal cross-sectional area of the retort. The off gas had an average heating value of less than about 50 BTU/SCF.

Figure 2:
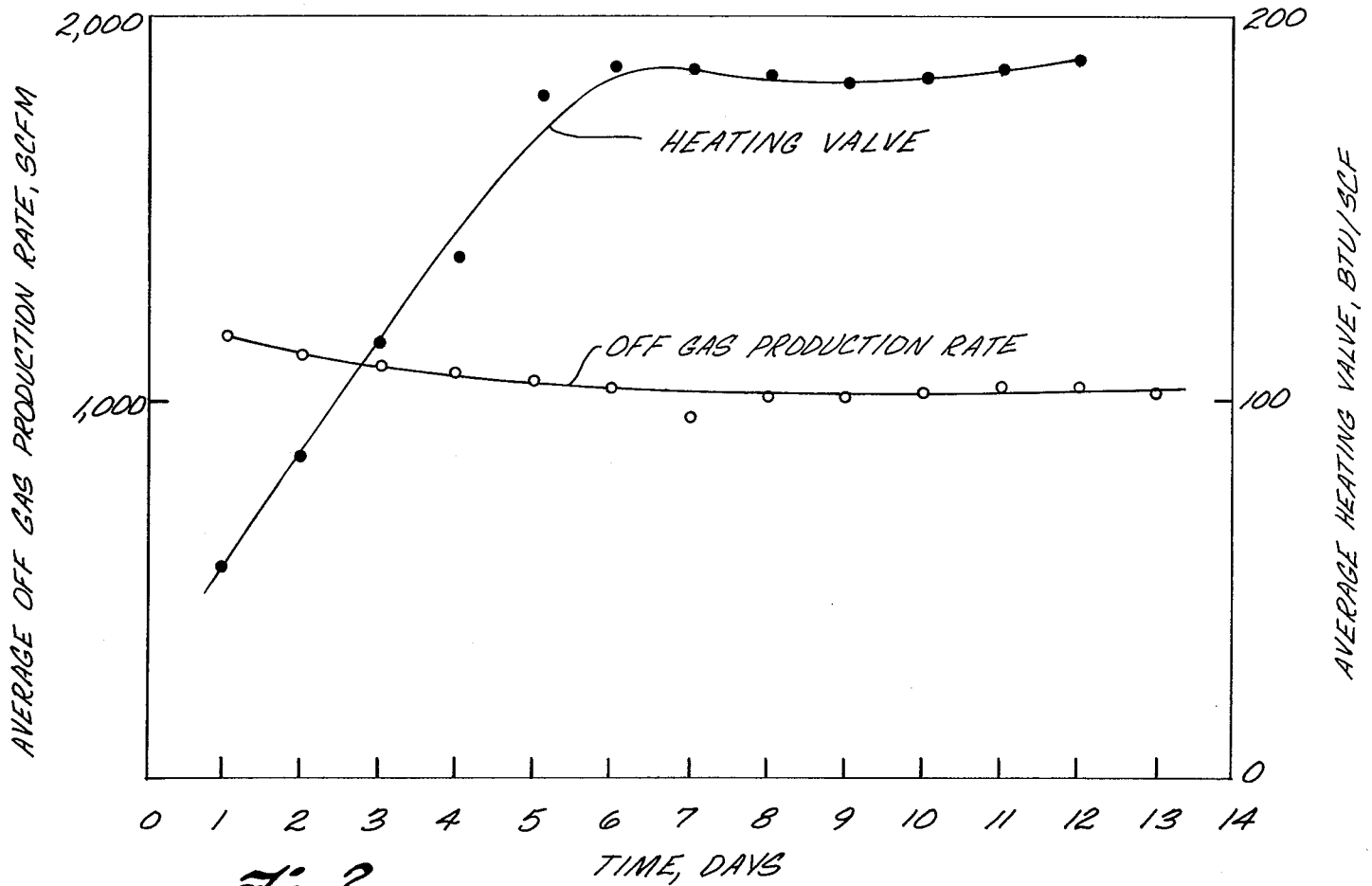
FIG. 2 is a graph showing the rate of production and average heating value of off gas produced during a post-retorting operation embodying features of this invention.

At the end of the normal retorting operation, a post-retorting operation was conducted. The bottom access to the fragmented mass was closed so that substantially no gas was introduced at the bottom of the retort. Off gas was withdrawn from the top of the in situ retort. The average off gas production rate and average heating value of the off gas as a function of time from commencing post-retorting operation are shown in FIG. 2. Thus, during the first two weeks of post-retorting operation off gas having a heating value of over 150 BTU/SCF was withdrawn. During this period the rate of off gas production was in the order of 1000 standard cubic feet per minute.

The off gas withdrawn during the first two weeks of operation had a total latent chemical heat of combustion of over 30 billion BTU. Since the total energy required for ignition of a retort having a horizontal cross section of 120 feet square is only about 1.5 billion BTU, off gas obtained from the post-retorting operation of the in situ retort can effectively be used for establishment of a combustion zone in a new retort of the same size.

During post-retorting operation the off gas withdrawn from the fragmented permeable mass had about 50 to 60% carbon dioxide (dry basis) with the balance made up primarily of gaseous hydrocarbons, hydrogen and carbon monoxide. Removal of carbon dioxide from the withdrawn off gas can raise the heating value to about 850 to 1000 BTU/SCF.

It will be noted that production rates of off gas and liquid products during normal retorting and during post-retorting operation are dependent on a number of factors. During normal retorting operation some of these factors include oil shale grade (Fischer Assay), size of the retort, retorting rate, inlet gas composition and the like. During post-retorting operation, production rates of off gas and liquid products depend on factors including oil shale grade, thickness or vertical height of the heated zone, size of the retort, and the like. Processes according to the present invention are particularly advantageous when employed in in situ oil shale retorts having substantial height and which have relatively rich oil shale near the bottom of the retort.

Post-retorting operation of an in situ oil shale retort can be conducted in three stages. During a first stage of post-retorting operation off gas is withdrawn from the top of the retort with the bottom closed. This off gas has a heating value in excess of about 150 BTU/SCF and is suitable for burning at the top of a second in situ oil shale retort for establishing a heated zone at a sufficiently high temperature for ignition. Thus, during the first stage of post-retorting operation the withdrawn off gas is employed for ignition of another in situ oil shale retort. Such a first stage of post-retorting operation can persist for at least about 2 weeks which provides ample energy for ignition of a second retort.

Thereafter, during a second stage of post-retorting operation the withdrawn off gas can be used for sustaining a secondary combustion zone in another in situ oil shale retort through which a primary combustion zone is advancing. Such a process including a secondary combustion zone is described in my copending U.S. patent application Ser. No. 728,911, filed Oct. 4, 1976, which is a continuation-in-part of application Ser. No. 648,358, filed Jan. 12, 1976, now abandoned, which is a continuation of application Ser. No. 465,097, filed Apr. 29, 1974, now abandoned, the disclosures of which are hereby incorporated by reference.

In the applications concerning a secondary combustion zone, there is described an in situ oil shale retort containing a fragmented permeable mass of particles containing oil shale. The retort has a primary combustion zone advancing therethrough. The inlet gas to the retort comprises a fuel and an oxygen supplying gas. These are introduced into a location in the fragmented mass on the trailing side of the combustion zone for forming a secondary combustion zone in the fragmented mass.

The retort feed mixture containing fuel and oxygen supplying gas has a spontaneous ignition temperature lower than the temperature in the primary combustion zone and burns at the location in the fragmented mass having a temperature corresponding to its spontaneous ignition temperature. This location can trail the primary combustion zone a considerable distance. Preferably sufficient heat is generated in the secondary combustion zone to maintain the temperature of the pillars adjacent the secondary combustion zone at a temperature above the retorting temperature of oil shale. If sufficient heat is generated in the secondary combustion zone it can remain in a substantially fixed location in the in situ oil shale retort as the primary combustion zone advances.

Withdrawn off gas should have a heating value of at least about 75 BTU/SCF to be employed for sustaining a secondary combustion zone in a fragmented permeable mass in another in situ retort. During such a second stage of post-retorting operation heating value of the off gas can continue at a relatively high level or can decrease somewhat. The average off gas production rate decreases gradually and a few months after the end of normal rotorting operation, the off gas production rate can be in the order of about one-fourth of the off gas production rate during the first stage of post-retorting operation.

During a third stage of post-retorting operation, the top of the retort is substantially closed and off gas is withdrawn from the bottom of the fragmented permeable mass. Such off gas can be commingled with off gas from other in situ retorts undergoing normal retorting or post-retorting operation. Off gas having a heating value of at least about 50 BTU/SCF can be burned for producing power.

Figure 3:
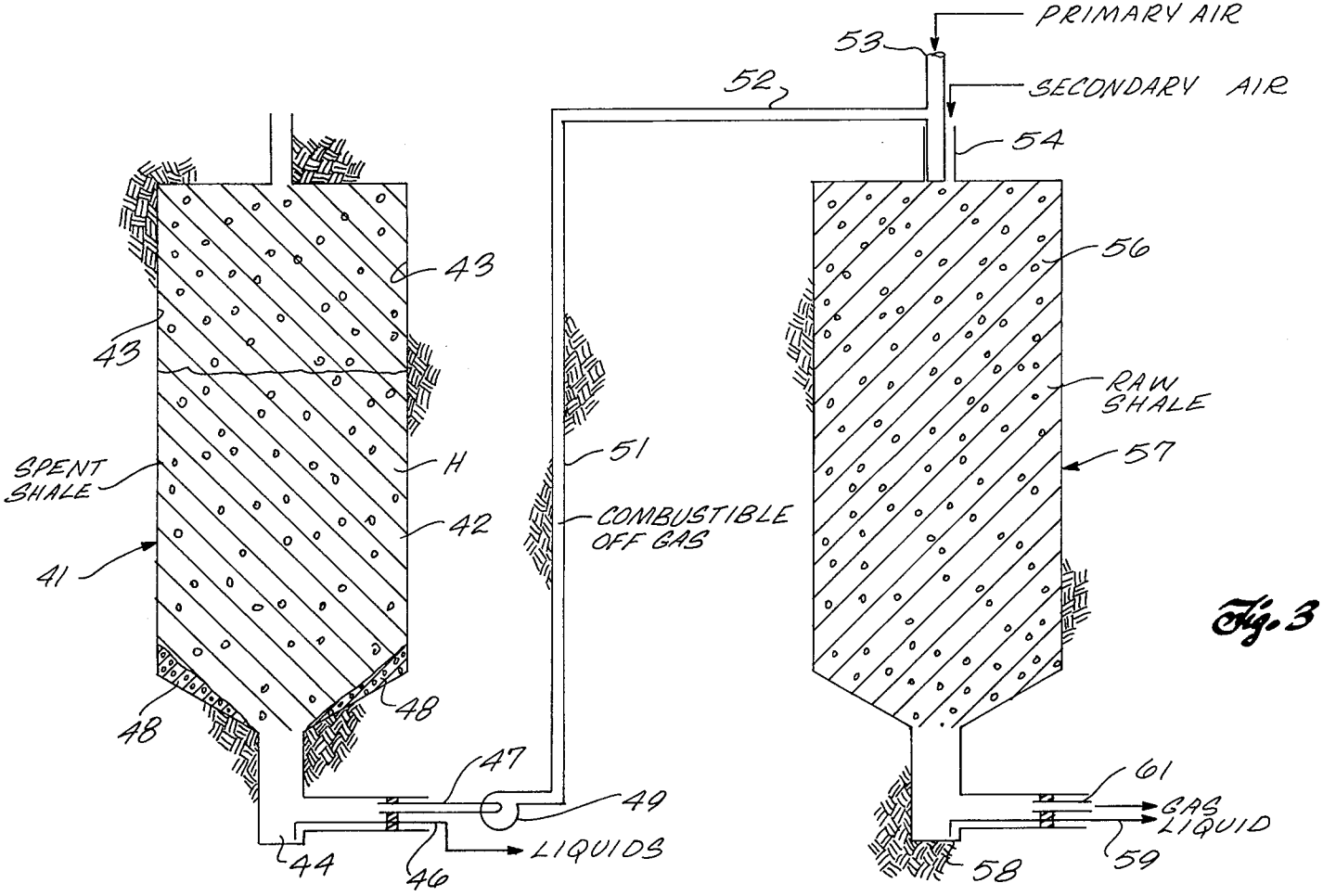
FIG. 3 is a schematic representation showing another embodiment wherein combustible off gas produced from post-retorting operation is used for starting a new in situ retort.

Referring to FIG. 3 there is an in situ oil shale retort 41 containing a fragmented permeable bed 42 of broken pieces of formation containing oil shale. The fragmented mass 42 is bounded by walls 43 or pillars of unfragmented formation. The retort 41 contains spent shale following normal in situ retorting operation and includes a heated zone H having substantial height. The spent shale can include a portion from which residual carbonaceous product has been burned as well as a portion not traversed by a combustion zone and hence containing solid residual carbonaceous product of kerogen decomposition. As hereinabove described such normal retorting operation can include establishment of a combustion zone adjacent the top of the retort and advancement of the combustion zone downwardly through the fragmented mass. Heat from the combustion zone establishes and advances a retorting zone on the advancing side of the combustion zone. A retorting zone can also be advanced through a fragmented mass by introduction of hot inert gas during normal retorting operation. Kerogen is decomposed in the retorting zone, producing liquid products, including shale oil, which are collected at a sump 44 and withdrawn from the bottom of the retort by way of a liquid conduit 46. Off gas including hydrocarbons, hydrogen and carbon monoxide is withdrawn from the bottom of the retort by way of a gas conduit 47.

Following the period of normal in situ retorting operation in the first retort 41, the major portion of the oil shale in the fragmented mass has been retorted, leaving spent shale 42 in most of the retort. In this embodiment due to gas flow maldistribution or channeling in the fragmented mass, there is illustrated an amount of unretorted oil shale 48 in the fragmented mass distributed around the bottom of the retort. The amount of such unretorted oil shale remaining in the fragmented mass after normal retorting operation is completed is dependent on the degree of gas flow channeling or maldistribution.

Temperature limitations of materials associated with withdrawing gaseous and liquid products from the bottom of the retort can prevent further retorting by substantial downward convective heat transfer by gas flow when the front of the retorting zone reaches near the location where off gas is withdrawn from the bottom of the retort. Thus, uneven flow of gas during normal retorting operation can result in a portion of the retorting zone front reaching the bottom of the retort sooner than other portions of the retorting zone front; thus, essentially preventing the use of downwardly flowing gas to retort some of the residual raw oil shale 48 in the fragmented mass at the bottom of the retort. Heat is transferred to and through such oil shale primarily by radiation and conduction.

The length or vertical height of the heated zone in the fragmented mass at temperatures above the retorting temperature of oil shale increases continually during normal retorting operation. Therefore, the greatest height of the heated zone is obtained at the end of normal retorting operation. Preferably the temperature of the heated zone is above about 1000° F. At such temperatures radiant heat transfer from the heated zone to residual raw oil shale remaining in the fragmented mass at the bottom of the retort is quite substantial.

Preferably the bottom of the retort is maintained at a slightly negative pressure, that is, at a pressure below the ambient pressure in adjacent underground workings. Such slightly negative pressure at the bottom of the retort is induced by continuously withdrawing off gas containing products of thermal decomposition including gaseous products from kerogen decomposition from the bottom of the retort by way of the conduit 47 and a gas blower 49 or the like.

Either of three gas inlet conditions can be maintained during such post-retorting operation of the in situ oil shale retort 41.

As a first inlet condition, preferably the top of the retort is substantially closed so that introduction of gas at the top of the fragmented mass in the retort is prevented. When this is done downward flow of heat by way of gas flow or convection is minimized. Further, gaseous products in off gas withdrawn from the retort are not diluted by inlet gas. Such post-retorting operation is similar to that hereinabove described with respect to FIG. 1.

As a second inlet condition, air flow into the top of the fragmented mass in the retort is maintained at a minimum sufficient to permit some combustion of carbonaceous material in the heated zone but insufficient to result in significant convective heat transfer. This can be accomplished either by reducing the rate of continuous air introduction or by providing intermittent air introduction by intermittently stopping air flow into the top of the retort. Such limited introduction of air during post-retorting operation can help maintain an elevated temperature in the heated zone.

As a third inlet condition, gas introduced during post-retorting operation can be a mixture containing water vapor and oxygen, such as a combination of steam and air. At the end of normal retorting operation of an in situ oil shale retort there can be a substantial volume of fragmented permeable mass containing retorted oil shale in which residual carbonaceous product from kerogen decomposition remains. Such retorted oil shale is at elevated temperature and the carbonaceous material is in an active state.

Water vapor can react with such residual carbonaceous product by the water gas reaction $$H_2O + C = H_2 + CO$$

Thus, some of the residual carbonaceous product can be used to produce combustible gases. The water gas reaction is endothermic and oxygen containing gas such as air is also introduced for exothermic reaction with some of the residual carbonaceous product for counterbalancing the endothermic reaction and maintaining a sufficiently elevated temperature for the water gas reaction to proceed. When operating according to the second or third alternative inlet conditions during post-retorting operation, the rate of introduction of gas to the top of the retort is less than about 10% of the rate of gas introduction during normal retorting operation. Such gas flow superimposed on gas flow from thermal decomposition does result in some transfer of heat by flowing gas. This can result in increase of temperature of off gas from the bottom of the in situ retort but since the total flow rate is small, such off gas can be easily cooled for handling.

It is preferable to completely stop introduction of gas to the top of the in situ oil shale retort during post-retorting operation since additions tend to dilute gas produced by thermal decomposition in the retort. Such dilution can reduce the heating value of the withdrawn off gas without sufficient concomitant benefit. Another result of completely stopping is that sensible heat in the heated zone in the fragmented mass adjacent the bottom of the retort is transferred by radiation and conduction to unretorted oil shale 48 located at the lower portion of the retort.

Shale oil produced during post-retorting operation has a relatively longer residence time in the heated zone than during normal retorting operation since a smaller quantity of liquid is produced and flow velocity is small. Therefore, shale oil produced by kerogen decomposition can undergo a secondary thermal cracking reaction resulting in production of combustible gas having a substantial heating value.

The heating value of the combustible off gas produced during post-retorting operation can have considerable variation due to carbon dioxide in the off gas which results from thermal decomposition of inorganics in the shale. When off gas is withdrawn from the top of the fragmented mass in the in situ retort, heating values in excess of about 150 BTU/SCF can be obtained for a substantial period. Heating values of 200 to 250 BTU/SCF can be obtained under some circumstances. When off gas is withdrawn from the bottom of an in situ oil shale retort during post retorting operation it can have a heating value of about 400 BTU/SCF. Lower heating values in the off gas withdrawn from the top of the retort can be attributed to additional dilution by carbon dioxide from thermal decomposition in the heated zone in the retort and additional thermal cracking of hydrocarbons to produce relatively lower density hydrogen. As mentioned above, heating value of post-retorting off gas from the in situ retort can depend at least partly on oil shale grade.

Since the rate of introduction of inlet gas to the fragmented permeable mass is low or stopped during post-retorting operation, the rate of cooling of the heated zone is slow. Due to this slow cooling rate the unfragmented walls 43 adjacent the lower portion of the in situ retort can be maintained at a high temperature for long post-retorting operation to maintain continuous heat conduction from the fragmented permeable mass adjacent the pillars into the pillars. Shale oil and combustible gases resulting from thermal decomposition of oil shale in unfragmented formation diffuse toward and into the fragmented mass in the retort, thereby recovering carbonaceous values from the unfragmented formation in the pillars. Since the greatest length or vertical height of unfragmented formation adjacent the heated zone is achieved at the end of normal retorting operation, the proportion of shale oil and gas production from the pillars in relation to shale oil and gas production from the fragmented mass in the retort is at a maximum at the end of normal retorting operation and the commencement of post-retorting operation.

Thus, it has been found in practice of this invention that in addition to shale oil and combustible gases recovered from any residual unretorted oil shale in the fragmented mass at the bottom of the retort, a significant amount of liquid and gaseous products is also recovered from the adjacent pillars during such post-retorting operation.

The rate of production of combustible off gas during post-retorting operation is sufficient for establishment of a heated zone in a new in situ oil shale retort. Thus, as one example, the rate of heat input for establishing an initial heated zone in an in situ oil shale retort was approximately 23 BTU/min per square foot of retort cross-sectional area. Post-retorting operation can produce combustible gas having a heating value of at least about 34 BTU/min per square foot.

Thus, in this embodiment during post-retorting operation combustible off gas withdrawn from the bottom of the first retort 41 by means of the blower 49 is conveyed upwardly through a raise or winze 51 to an upper level in the underground workings. A conduit 52 conveys such combustible off gas to a retort ignition burner 53. The burner 53 is positioned in a gas access means 54 leading to the top of a fragmented permeable mass 56 of raw or unretorted oil shale in a second in situ oil shale retort 57. Primary air and secondary air are also introduced and the combustible off gas introduced into the burner 53 is ignited to establish a heated zone in the new retort 57. The flue gases from the burner 53 heat the top of the fragmented permeable mass and initiate the retorting process. The combustion of off gas is continued at least until the upper portion of the fragmented mass reaches a sufficiently high temperature to sustain combustion in a combustion zone. Temperatures of about 1200° to 1400° F are desirable to assure self-sustaining combustion.

At this stage burning of combustible off gas by means of the burner 53 is discontinued and normal retorting operation is conducted by introducing air and off gas from the conduit 52 into the top of the second retort 57. Introduction of off gas to the top of the second fragmented permeable mass can be discontinued when the fragmented mass will sustain combustion or if desired can be continued to sustain a secondary combustion zone as hereinabove described. Off gas can also be used to dilute inlet air to reduce oxygen concentration without requiring appreciable heating value.

Retorting of the second in situ retort 57 can be conducted by normal retorting operation with liquid products withdrawn from a sump 58 by way of a liquid conduit 59. Off gas is withdrawn from the bottom of the second retort by way of a gas conduit 61.

It is preferred to withdraw relatively high heating value off gas from the top of an in situ oil shale retort during post retorting operations and convey such gas to the top of a new in situ oil shale retort since this minimizes the length and complexity of piping that is needed. The new in situ oil shale retort is ignited at the top and by withdrawing relatively rich off gas from the top of the spent oil shale retort the gas can be conducted to the new retort at the same level in the underground workings. This avoids any need for a raise or winze through which off gas must flow between different levels in the underground workings.

When off gas is withdrawn from the bottom of the retort during post-retorting operation, there can also be appreciable production of shale oil and water from the retort. Liquid products percolate to the sump and are recovered. The production rate of liquid products during post-retorting operation is considerably lower than during normal in situ oil shale retorting.

When off gas is withdrawn from the top of the retort during post-retorting operation, no more than a small amount of shale oil and water percolates to the sump at the bottom of the retort. Liquid decomposition products of kerogen pass through high temperature regions of the in situ oil shale retort and are subjected to thermal cracking conditions. Most or all of the carbonaceous materials are cracked to produce gaseous products which enrich the relatively high heating value off gas.

When off gas is withdrawn from the bottom of the retort during post-retorting operation, oxygen containing gas can be introduced at the top of the fragmented permeable mass for limited combustion. The heated zone can include a substantial amount of carbonaceous residue, combustion of which depletes the oxygen concentration of the gas and avoids burning combustible components of off gas produced near the bottom of the retort. It is desirable to prevent introduction of oxygen containing gas into the bottom of an in situ oil shale retort when off gas is withdrawn from the top. The greater proportion of liquid and gaseous products are produced near the bottom. These can be oxidized before such gas introduced at the bottom passes through a sufficient thickness of heated zone containing carbonaceous residue to adequately deplete oxygen in the introduced gas.

While particular embodiments of processes provided in practice of this invention have been described herein for purposes of illustration, it will be understood that various changes and modifications within the spirit of the invention can be made. Thus, for example, in the embodiments illustrated in the drawings relatively rich off gas from post-retorting operation of a retort is introduced at the top of a second retort for ignition or for sustaining a secondary combustion zone. It will be apparent that relatively high heating value off gas from post-retorting operation can be used for other purposes such as production of power, making steam for injecting in a retort, product heating or general heating of facilities and equipment. It is therefore to be understood that the invention is not limited except by the scope of the appended claims.

What is claimed is:

1. A process for recovering liquid and gaseous products from oil shale in an in situ oil shale retort in a subterranean formation containing oil shale, the retort containing a fragmented permeable mass of formation particles containing oil shale, comprising the steps of:

establishing a heated zone in the fragmented mass, the heated zone having a temperature higher than the retorting temperature of oil shale;

for a first period of normal retorting operation introducing a processing gas to the fragmented mass on a trailing side of the heated zone at a sufficient rate for advancing the heated zone through the fragmented mass for retorting oil shale to produce liquid and gaseous products, and withdrawing liquid products and off gas containing gaseous products from the retort on an advancing side of the heated zone, and thereafter for a second period of post-retorting operation reducing the rate of introduction of gas to the fragmented mass, and withdrawing from the retort an off gas comprising gaseous products from retorting oil shale, the rate of introduction of gas to the fragmented mass being such that withdrawn off gas has a heating value of at least about 150 BTU/SCF.

2. A process as recited in claim 1 in which the step of reducing introduction of gas comprises substantially completely stopping introduction of gas to the fragmented mass.

3. A process as recited in claim 1 wherein during the post-retorting operation gas containing water vapor is introduced into the in situ retort for water gas reaction with residual carbonaceous product from retorting oil shale in the heated zone, and wherein the off gas withdrawn includes reaction products of the water gas reaction.

4. A process as recited in claim 4 wherein the introduced gas containing water vapor also contains oxygen for exothermic reaction for at least partly counterbalancing endothermic water gas reaction.

5. In a process as recited in claim 1 wherein during the period of normal retorting operation the heated zone is advanced downwardly through the fragmented mass, the further improvement during the period of post-retorting operation comprising the steps of:

conveying at least a portion of the off gas from the top of the in situ retort to the top of another in situ oil shale retort containing an unretorted fragmented permeable mass of particles containing oil shale; and burning the conveyed off gas at the top of the retort containing an unretorted fragmented mass for establishing a heated zone therein.

6. In a process as recited in claim 1 the further improvement wherein pressure in the in situ retort during post-retorting operation is maintained below ambient pressure in adjacent underground workings.

7. A process for recovering liquid and gaseous products from oil shale in an in situ oil shale retort in a subterranean formation containing oil shale, the retort containing a fragmented permeable mass of formation particles containing oil shale, comprising the steps of:

establishing a heated zone in the fragmented mass, the heated zone having a temperature higher than the retorting temperature of oil shale;

for a first period of normal retorting operation introducing a processing gas to the fragmented mass on a trailing side of the heated zone at a sufficient rate for advancing the heated zone through the fragmented mass for retorting oil shale to produce liquid and gaseous products, and withdrawing liquid products and off gas containing gaseous products from the retort on an advancing side of the heated zone; and for a second period of post-retorting operation reducing the introduction of gas to the fragmented mass to a rate less than about 10% of the rate of introduction of gas during normal retorting operation, and withdrawing from the retort an off gas comprising gaseous products from retorting oil shale.

8. A process as recited in claim 7 in which the step of reducing introduction of gas comprises substantially completely stopping introduction of gas to the fragmented mass.

9. A process as recited in claim 7 wherein introduction of gas is reduced to a rate such that off gas withdrawn from the retort during the period of post-retorting operation has a heating value of at least about 75 BTU/SCF.

10. A process as recited in claim 7 wherein introduction of gas is reduced to a rate such that off gas withdrawn from the retort during the period of post-retorting operation has a heating value of at least about 150 BTU/SCF.

11. A process as recited in claim 7 wherein during the post-retorting operation gas containing water vapor is introduced into the in situ retort for water gas reaction with residual carbonaceous product from retorting oil shale in the heated zone, and wherein the off gas withdrawn includes reaction products of the water gas reaction.

12. A process as recited in claim 11 wherein the introduced gas containing water vapor also contains oxygen for exothermic reaction for at least partly counterbalancing endothermic water gas reaction.

13. A process as recited in claim 7 wherein at least a portion of the subterranean formation adjacent the heated zone in the fragmented mass remains at a temperature of at least about 1000° F during post-retorting operation.

14. A process for recovering liquid and gaseous products from oil shale in an in situ oil shale retort in a subterranean formation containing oil shale, the retort containing a fragmented permeable mass of formation particles containing oil shale, comprising the steps of:

establishing a heated zone in the fragmented mass, the heated zone having a temperature higher than the retorting temperature of oil shale;

for a first period of normal retorting operation introducing a processing gas to the fragmented mass on a trailing side of the heated zone at a sufficient rate for advancing the heated zone through the fragmented mass for retorting oil shale to produce liquid and gaseous products, and withdrawing liquid products and off gas containing gaseous products from the retort on an advancing side of the heated zone; and for a second period of post-retorting operation introducing gas to the fragmented mass at a rate less than about 10% of the rate of introduction of gas during normal retorting operation, and withdrawing from the retort an off gas comprising gaseous products from retorting oil shale.

15. A process as recited in claim 14 wherein gas is introduced at a rate such that off gas withdrawn from the retort during the period of post-retorting operation has a heating value of at least about 75 BTU/SCF.

16. A process as recited in claim 14 wherein gas is introduced at a rate such that off gas withdrawn from the retort during the period of post-retorting operation has a heating value of at least about 150 BTU/SCF.

17. A process as recited in claim 14 wherein during the post-retorting operation gas containing water vapor is introduced into the in situ retort for water gas reaction with residual carbonaceous product from retorting oil shale in the heated zone, and wherein the off gas withdrawn includes reaction products of the water gas reaction.

18. A process as recited in claim 17 wherein the introduced gas containing water vapor also contains oxygen for exothermic reaction for at least partly counterbalancing endothermic water gas reaction.

19. In a process as recited in claim 14 the further improvement wherein pressure in the in situ retort during post-retorting operation is maintained below ambient pressure in adjacent underground workings.

20. A process as recited in claim 14 wherein at least a portion of the subterranean formation adjacent the heated zone in the fragmented mass remains at a temperature of at least about 1000° F during post-retorting operation.

21. A process for recovering liquid and gaseous products from oil shale in an in situ oil shale retort in a subterranean formation containing oil shale, the retort containing a fragmented permeable mass of formation particles containing oil shale, comprising the steps of:

establishing a heated zone in the fragmented mass, the heated zone having a temperature higher than the retorting temperature of oil shale;

for a first period of normal retorting operation introducing a processing gas to the fragmented mass on a trailing side of the heated zone at a sufficient rate for advancing the heated zone through the fragmented mass for retorting oil shale to produce liquid and gaseous products, and withdrawing liquid products and off gas containing gaseous products from the retort on an advancing side of the heated zone; and for a second period of post-retorting operation introducing gas to the fragmented mass and withdrawing from the retort an off gas comprising gaseous products from retorting oil shale, the rate of introduction of gas to the fragmented mass being such that withdrawn off gas has a heating value of not less than about 150 BTU/SCF.

22. A process as recited in claim 21 wherein during the post-retorting operation gas containing water vapor is introduced into the in situ retort for water gas reaction with residual carbonaceous product from retorting oil shale in the heated zone, and wherein the off gas withdrawn includes reaction products of the water gas reaction.

23. A process as recited in claim 22 wherein the introduced gas containing water vapor also contains oxygen for exothermic reaction for at least partly counterbalancing endothermic water gas reaction.

24. A process for recovering liquid and gaseous products from oil shale in a first in situ oil shale retort in a subterranean formation containing oil shale, the retort containing a fragmented permeable mass of formation particles containing oil shale, comprising the steps of:

establishing a heated zone in a portion of the fragmented mass, the heated zone having a temperature higher than the retorting temperature of oil shale;

for a period of normal retorting operation introducing a processing gas to a portion of the fragmented mass on a trailing side of the heated zone at a sufficient rate for advancing the heated zone through the fragmented mass for retorting oil shale to produce liquid and gaseous products, and withdrawing liquid products and off gas containing gaseous products from the retort; and thereafter for a period of post-retorting operation substantially completely stopping introduction of gas to the retort; continuing to withdraw a post-retorting off gas from the top of the retort, said post-retorting off gas comprising gaseous products from retorting oil shale; conveying at least a portion of the post-retorting off gas from the first in situ retort to a second in situ oil shale retort containing an unretorted fragmented permeable mass of particles containing oil shale; and burning the conveyed post-retorting off gas at an inlet to the second retort for establishing a heated zone therein.

25. A process as recited in claim 24 wherein pressure in the first in situ retort during post-retorting operation is maintained below ambient pressure in adjacent underground workings.

26. A process as recited in claim 24 wherein off gas withdrawn from the first retort and conveyed to the second retort during the period of post-retorting operation has a heating value of at least about 150 BTU/SCF.

27. A process as recited in claim 24 further comprising the steps of:

withdrawing off gas having a heating value of at least about 75 BTU/SCF from the first retort after a heated zone is established in the second retort;

introducing at least a portion of the off gas having a heating value of at least about 75 BTU/SCF into the second retort; and introducing an oxygen containing gas into the second retort for combustion of the off gas.

28. A process for recovering liquid and gaseous products from oil shale in a first in situ oil shale retort in a subterranean formation containing oil shale, the retort containing a fragmented permeable mass of formation particles containing oil shale, comprising the steps of:

establishing a heated zone in an upper portion of the fragmented mass, the heated zone having a temperature higher than the retorting temperature of oil shale;

for a first period of normal retorting operation introducing a processing gas to an upper portion of the fragmented mass on a trailing side of the heated zone at a sufficient rate for advancing the heated zone downwardly through the fragmented mass for retorting oil shale to produce liquid and gaseous products, and withdrawing liquid products and off gas containing gaseous products from the bottom of the retort; and for a second period of post-retorting operation substantially closing the bottom of the retort; withdrawing an off gas from the top of the retort, said post-retorting off gas comprising gaseous products from retorting oil shale and having a heating value of at least about 75 BTU/SCF;

introducing at least a portion of the off gas from the top of the first retort into the top of a second in situ oil shale retort containing an at least partly unretorted, fragmented permeable mass of particles containing oil shale; and introducing an oxygen containing gas into the top of the second retort for combustion of the post-retorting off gas.

29. A process as recited in claim 28 wherein off gas withdrawn from the first retort and conveyed to the second during the period of post-retorting operation has a heating value of at least about 150 BTU/SCF.

30. A process as recited in claim 28 wherein at least a portion of the subterranean formation adjacent the heated zone in the fragmented mass remains at a temperature of at least about 1000° F during post-retorting operation.

31. In a process for recovering liquid and gaseous products from oil shale in an in situ oil shale retort in a subterranean formation containing oil shale wherein during normal retorting operation, a retorting zone is advanced downwardly through a fragmented permeable mass of formation particles containing oil shale in the retort, the improvement in post-retorting operation after normal retorting operation during which a retorting zone is advanced substantially completely through the fragmented mass wherein:

the bottom of the retort is substantially closed during post-retorting operation; and off gas including gaseous products from retorting oil shale is withdrawn from the top of the in situ retort.

32. In a process as recited in claim 31 the further improvement wherein pressure in the in situ retort during post-retorting operation is maintained below ambient pressure in adjacent underground workings.

33. In a process as recited in claim 31 the further improvement comprising the steps of:

conveying at least a portion of the off gas from the top of the in situ retort to the top of another in situ oil shale retort containing an unretorted fragmented permeable mass of particles containing oil shale; and burning the conveyed off gas at the top of the retort containing an unretorted fragmented mass for establishing a heated zone therein.

34. A process for recovering post-retorting off gas from an in situ oil shale retort in a subterranean formation containing oil shale, the retort containing a fragmented permeable mass of formation particles containing oil shale comprising the steps of:

establishing a heated zone in an upper portion of the fragmented mass, the heated zone having a temperature higher than the retorting temperature of oil shale;

for a first period of normal retorting operation introducing an inlet gas to an upper portion of the fragmented mass on the trailing side of the heated zone for advancing the heated zone through the fragmented mass for retorting oil shale to produce liquid and gaseous products and withdrawing such liquid products and off gas including such gaseous products from a lower portion of the in situ retort; and for a second period of post-retorting operation substantially closing the lower portion of the in situ retort and withdrawing from the upper portion of the retort an off gas comprising gaseous products from retorting oil shale.

35. A process as recited in claim 34 wherein off gas withdrawn from the upper portion of the retort during post-retorting operation has a heating value of at least about 75 BTU/SCF.

36. A process as recited in claim 34 wherein off gas withdrawn from the upper portion of the retort during post-retorting operation has a heating value of at least about 150 BTU/SCF.

37. A process as recited in claim 36 further comprising the steps of:

conveying at least a portion of the off gas from the top of the in situ retort to the top of another in situ oil shale retort containing an unretorted fragmented permeable mass of particles containing oil shale; and burning the conveyed off gas at the top of the retort containing an unretorted fragmented mass for establishing a heated zone therein.

38. A process as recited in claim 34 wherein pressure in the in situ retort during post-retorting operation is maintained below ambient pressure in adjacent underground workings.

39. In a process for recovering carbonaceous values from unretorted oil shale at the lower portion of an in situ oil shale retort containing a fragmented permeable mass of particles containing oil shale after retorting a substantial portion of the fragmented mass in said in situ oil shale retort by a method which includes establishing a combustion zone in the fragmented permeable mass and introducing oxygen-containing inlet gas downwardly into said in situ oil shale retort at a sufficient flow rate for retorting particles containing oil shale to produce liquid and gaseous products and dekerogenated particles containing residual carbonaceous product and to advance the combustion zone toward the bottom of said in situ oil shale retort; the improvement comprising during a period of post-retorting operation:

introducing oxygen-containing inlet gas downwardly into said in situ oil shale retort at a rate substantially below the rate of downward introduction of oxygen-containing inlet gas into said retort during retorting and sufficient to maintain combustion in said in situ oil shale retort for producing gaseous products from unretorted oil shale at the lower portion of the retort, and withdrawing sufficient gas including gaseous products from the bottom of the in situ oil shale retort to reduce the pressure at the bottom of the in situ oil shale retort to less than ambient pressure in adjacent underground workings.

40. A process as recited in claim 39 wherein gas is introduced at a rate such that the gas withdrawn from the bottom of the retort during post-retorting operation has a heating value of at least about 75 BTU/SCF.

41. In a process for recovering liquid and gaseous products from a fragmented permeable mass of formation particles containing oil shale in an in situ oil shale retort in a subterranean formation containing oil shale wherein during normal retorting operation a processing gas is introduced to the retort and an off gas is withdrawn from the retort for advancing a retorting zone substantially completely through the fragmented permeable mass of formation particles containing oil shale in the retort, the improvement in post-retorting operation comprising the steps of terminating introduction of gas to the in situ retort and withdrawing a post-retorting off gas including gaseous products from retorting oil shale from the in situ retort.

42. In a process as recited in claim 41 the improvement wherein off gas is withdrawn from the in situ retort from the same end of the retort as gas was introduced during normal retorting operation.

43. A process for recovering post-retorting off gas from an in situ oil shale retort in a subterranean formation containing oil shale, the retort containing a fragmented permeable mass of formation particles containing oil shale comprising the steps of:

establishing a heated zone in a portion of the fragmented mass, the heated zone having a temperature higher than the retorting temperature of oil shale;

for a period of normal retorting operation introducing an inlet gas to the fragmented mass on a trailing side of the heated zone for advancing the heated zone through the fragmented mass for retorting oil shale to produce liquid and gaseous products and withdrawing such liquid products and off gas including such gaseous products from the in situ retort on an advancing side of the heated zone; and thereafter for a period of post-retorting operation substantially completely stopping introduction of gas to the in situ retort and withdrawing from the retort a post-retorting off gas comprising gaseous products from retorting oil shale.

44. A process as recited in claim 43 wherein off gas withdrawn from the retort during post-retorting operation has a heating value of at least about 75 BTU/SCF.

45. A process as recited in claim 43 wherein off gas withdrawn from the retort during post-retorting operation has a heating value of at least about 150 BTU/SCF.

* * * * *

UNITED STATES PATENT AND TRADEMARK OFFICE

CERTIFICATE OF CORRECTION

PATENT NO. : 4,105,072

DATED : August 8, 1978

INVENTOR(S) : CHANG YUL CHA

It is certified that error appears in the above-identified patent and that said Letters Patent are hereby corrected as shown below:

Col. 1, line 37, "change" should be -- chance --.

Col. 6, line 57, after "post-retorting" and before "as" insert -- operation --.

Col. 7, line 44, delete "1515;%" and insert therefor -- about 15% --.

Col. 15, line 31 "," should be -- ; -- .

Col. 15, line 50, after "claim" and before "wherein", "4" should be -- 3 -- .

Signed and Sealed this

*Sixth* Day of *May 1980*

[SEAL]

*Attest:*

SIDNEY A. DIAMOND

*Attesting Officer*

*Commissioner of Patents and Trademarks*